US011149749B2

(12) United States Patent
Moriya et al.

(10) Patent No.: US 11,149,749 B2
(45) Date of Patent: Oct. 19, 2021

(54) IMPELLER, IMPELLER BLADE WHEEL, AIR-BLOWING DEVICE, AND METHOD OF MANUFACTURING AIR-BLOWING DEVICE

(71) Applicant: Nidec Corporation, Kyoto (JP)

(72) Inventors: Shigeyuki Moriya, Kyoto (JP); Hidehiko Hidaka, Kyoto (JP); Toshihiro Kawahara, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 221 days.

(21) Appl. No.: 16/118,506

(22) Filed: Aug. 31, 2018

(65) Prior Publication Data

US 2019/0093673 A1 Mar. 28, 2019

(30) Foreign Application Priority Data

Sep. 28, 2017 (JP) ..... JP2017-188350

(51) Int. Cl.
*F04D 29/66* (2006.01)
*F04D 29/22* (2006.01)
(Continued)

(52) U.S. Cl.
CPC ..... *F04D 29/662* (2013.01); *F04D 29/20* (2013.01); *F04D 29/2261* (2013.01);
(Continued)

(58) Field of Classification Search
CPC .. F04D 29/2288; F04D 29/281; F04D 29/282; F04D 29/662; F04D 29/2261; F05B 2260/966
See application file for complete search history.

(56) References Cited

U.S. PATENT DOCUMENTS 3,746,467 A * 7/1973 Buse ..... F04D 29/2288 416/186 R
8,167,562 B2 * 5/2012 Sakai ..... F04D 29/662 416/178
(Continued)

FOREIGN PATENT DOCUMENTS

CN 208870840 U 5/2019
JP 2000-54988 A 2/2000
(Continued)

*Primary Examiner* — Kenneth Bomberg
*Assistant Examiner* — Christopher R Legendre
(74) *Attorney, Agent, or Firm* — Keating & Bennett, LLP

(57) ABSTRACT

An impeller that rotates about a central axis extending vertically includes a base portion and blades. The base portion spreads perpendicularly to the central axis. The blades are on an upper surface of the base portion at intervals in a circumferential direction. The base portion includes an irregular portion that is radially outward and in which irregularities are repeated in the circumferential direction. The irregular portion includes one or more first irregular regions and a second irregular region. The first irregular regions include first recesses with a same shape and first projections with a same shape, the first recesses and projections being alternately arranged one by one. The second irregular region is positioned between the first irregular regions and includes at least one among a second recess with a different shape from the first recesses and a second projection with a different shape from the first projections.

12 Claims, 15 Drawing Sheets

(51) Int. Cl.
*F04D 29/28* (2006.01)
*F04D 29/20* (2006.01)

(52) U.S. Cl.
CPC ..... *F04D 29/281* (2013.01); *F04D 29/287* (2013.01); *F05B 2230/21* (2013.01); *F05B 2240/90* (2013.01); *F05B 2250/19* (2013.01); *F05B 2260/966* (2013.01)

(56) References Cited

U.S. PATENT DOCUMENTS

| | | | | |
|---|---|---|---|---|
| 8,568,110 | B2 * | 10/2013 | Takeshita | H02K 5/1735 417/353 |
| 10,428,835 | B2 * | 10/2019 | Kurihara | G01M 1/36 |
| 2001/0025602 | A1 * | 10/2001 | Trionfetti | F04D 29/662 118/319 |
| 2005/0111971 | A1 | 5/2005 | Fukizawa et al. | |
| 2006/0250033 | A1 * | 11/2006 | Vasilescu | H02K 9/06 310/62 |
| 2015/0322793 | A1 * | 11/2015 | Takabatake | F02C 6/12 416/183 |
| 2017/0058911 | A1 * | 3/2017 | Baryshnikov | F04D 29/2272 |
| 2019/0093673 | A1 * | 3/2019 | Moriya | F04D 29/662 |

FOREIGN PATENT DOCUMENTS

| | | | |
|---|---|---|---|
| JP | 2017-203427 | A | 11/2017 |
| KR | 20-2013-0006283 | U | 10/2013 |

* cited by examiner

IMPELLER, IMPELLER BLADE WHEEL, AIR-BLOWING DEVICE, AND METHOD OF MANUFACTURING AIR-BLOWING DEVICE

CROSS REFERENCE TO RELATED APPLICATIONS

This application claims the benefit of priority to Japanese Patent Application No. 2017-188350 filed on Sep. 28, 2017. The entire contents of this application are hereby incorporated herein by reference.

BACKGROUND OF THE INVENTION

1. Field of the Invention

The present invention relates to an impeller, an impeller blade wheel, an air-blowing device, and a method of manufacturing an air-blowing device.

2. Description of the Related Art

To date, a centrifugal fan having a plurality of blades of an air-blowing device that discharges air sucked from a central suction port in an outer circumferential direction is known. In the centrifugal fan, in many cases, an annular machining margin centered on a rotating shaft is integrally formed on a disc-shaped end plate integrally supporting a plurality of blades. Because the machining margin is integrally formed in an annular shape on the end plate of the centrifugal fan, balancing can be easily performed by scraping off a required portion of the machining margin.

An existing balance adjustment method for an impeller is a minus balance adjustment in which balance adjustment is performed by lightening a portion of the impeller. In the minus balance adjustment, when the amount of imbalance increases, the amount of scraping off of the impeller increases and there is a possibility that the number of machining steps may increase.

As a method of adjusting the balance of the impeller, plus balance adjustment for adjusting the balance of the whole impeller by adding weight to a portion of the impeller is also known. However, in the plus balance adjustment, for example, when thinning of the impeller is required, it may be difficult to secure a portion to which weight is to be attached.

SUMMARY OF THE INVENTION

An exemplary preferred embodiment of the present invention provides an impeller that rotates about a vertically-extending central axis, and includes a base portion and a plurality of blades. The base portion spreads out in a direction perpendicular or substantially perpendicular to the central axis. The plurality of blades are disposed on an upper surface of the base portion at spaced intervals in a circumferential direction. The base portion includes, on an outer side thereof in a radial direction, an irregular portion in which irregularities are repeated in the circumferential direction. The irregular portion includes one or more first irregular regions and a second irregular region. The first irregular regions include a plurality of first recessed portions with a same shape and a plurality of first projecting portions with a same shape, the first recessed portions and the first projecting portions being alternately arranged one by one. The second irregular region located between the first irregular regions includes at least one of a second recessed portion with a shape different from that of the first recessed portions and a second projecting portion with a shape different from that of the first projecting portions.

An impeller blade wheel according to an exemplary preferred embodiment of the present invention includes the impeller described above and a shaft connected to the impeller.

An air-blowing device according to an exemplary preferred embodiment of the present invention includes the above-described impeller blade wheel, a magnet disposed outward of the shaft in the radial direction, and a stator that opposes the magnet in the radial direction.

A method of manufacturing an air-blowing device according to an exemplary preferred embodiment of the present invention is a method of manufacturing an air-blowing device including an impeller, including a) a step of molding a balanced impeller that includes providing a region to increase weight by scraping off a projecting side of irregularities regularly arranged in a mold, and b) a step of adjusting a balance of the impeller that includes, at a time of assembling a rotating portion including the impeller, scraping off projecting portions of the impeller defined by the irregularities to reduce a weight of the impeller.

The above and other elements, features, steps, characteristics and advantages of the present disclosure will become more apparent from the following detailed description of the preferred embodiments with reference to the attached drawings.

DETAILED DESCRIPTION OF THE PREFERRED EMBODIMENTS

Figure 1:
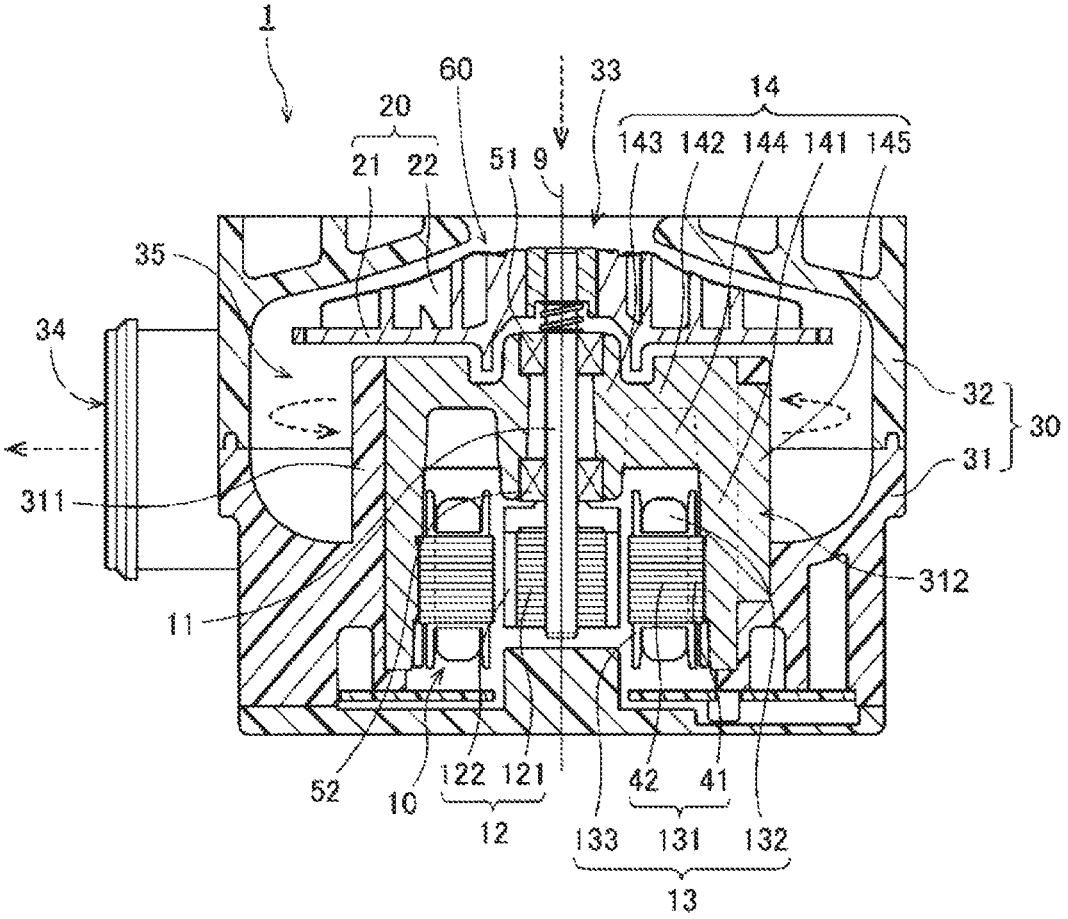
FIG. 1 is a longitudinal sectional view of an air-blowing device according to a first preferred embodiment of the present invention.

Hereinafter, exemplary embodiments of the present invention will be described in detail with reference to the drawings. In the present specification, the direction along a central axis 9 illustrated in FIG. 1 is referred to as the axial direction, the direction perpendicular to the central axis 9 is referred to as the radial direction, and the direction along a circular arc with the central axis 9 as the center is referred to as the circumferential direction. In addition, in the present specification, the shape and positional relationship of each element will be described with the axial direction as the vertical direction and an impeller 20 side with respect to a motor 10 being defined as up. However, in practicality there is no intention to limit the orientation of the impeller, impeller blade wheel, and air-blowing device of the present invention to this vertical definition.

FIG. 1 is a longitudinal sectional view of an air-blowing device 1 according to a first embodiment of the present invention. The air-blowing device 1 is a so-called centrifugal blowing device in which the impeller 20 is rotated by the power of the motor 10 in order to send air sucked in the axial direction in a tangential direction.

As illustrated in FIG. 1, the air-blowing device 1 of the present embodiment includes the motor 10, the impeller 20, and a casing 30.

The motor 10 is a drive source for rotating the impeller 20. The motor 10 has a shaft 11, a rotor 12, a stator 13, and a stator housing 14. The shaft 11 is a columnar member arranged along the central axis 9. The impeller 20 is fixed to an upper end portion of the shaft 11. In contrast, the rotor 12 is fixed to a lower end portion of the shaft 11. That is, in the present embodiment, the rotor 12 and the impeller 20 are fixed to each other via the shaft 11.

The rotor 12 has a rotor core 121, which has a cylindrical shape, and a magnet 122. For the rotor core 121, for example, a laminated steel plate, which is a magnetic body, is used. The magnet 122 is fixed to the outer peripheral surface of the rotor core 121. N poles and S poles are alternately magnetized in the circumferential direction on the outer surface of the magnet 122 in the radial direction. Further, note that the magnet 122 may be composed of a plurality of magnets or may be composed of a single magnet that has an annular shape. In addition, the rotor core 121 may be omitted, and the rotor 12 may be constituted by the magnet 122, which has a cylindrical shape.

The stator 13 is disposed outside the rotor 12 in the radial direction. The stator 13 has a stator core 131 and a plurality of coils 132. For the stator core 131, for example, a laminated steel plate, which is a magnetic body, is used. The stator core 131 has a core back 41, which has an annular shape, and a plurality of teeth 42 that protrude inward in the radial direction from the core back 41. The plurality of teeth 42 are arranged at equal intervals in the circumferential direction. The plurality of coils 132 are composed of conductive wires wound around the teeth 42. A resin insulator 133 is interposed between the teeth 42 and the coils 132. As a result, the teeth 42 and the coils 132 are electrically insulated from each other.

When a driving current is supplied to the coils 132, a magnetic flux is generated in the plurality of the teeth 42. Then, due to the action of the magnetic flux between the teeth 42 and the magnet 122, circumferential torque is generated. As a result, the rotor 12 and the shaft 11 rotate about the central axis 9. When the shaft 11 rotates, the impeller 20, which is fixed to the shaft 11, also rotates about the central axis 9.

Figure 2:
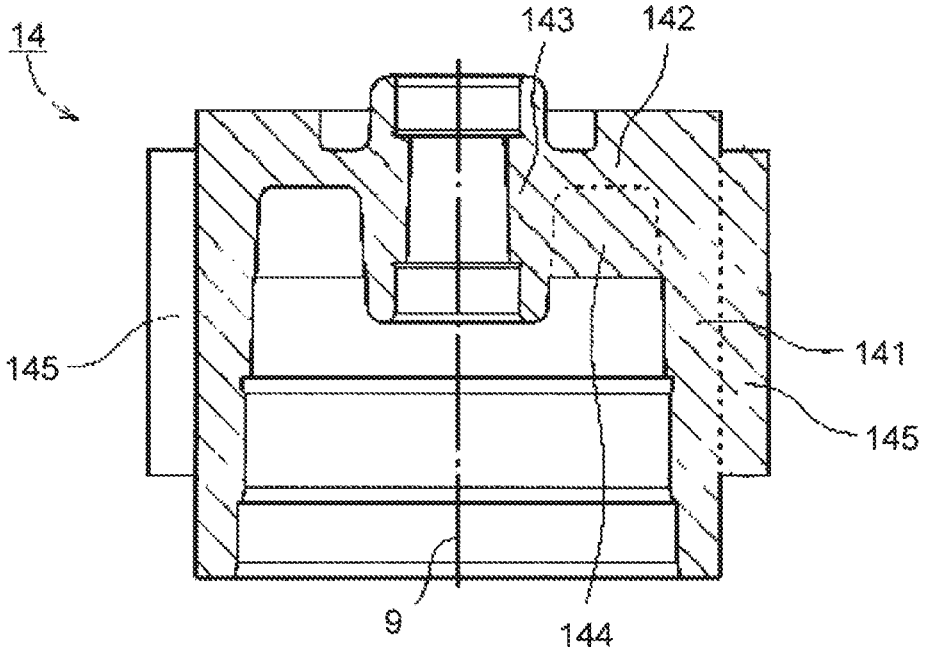
FIG. 2 is a longitudinal sectional view of a stator housing.
Figure 3:
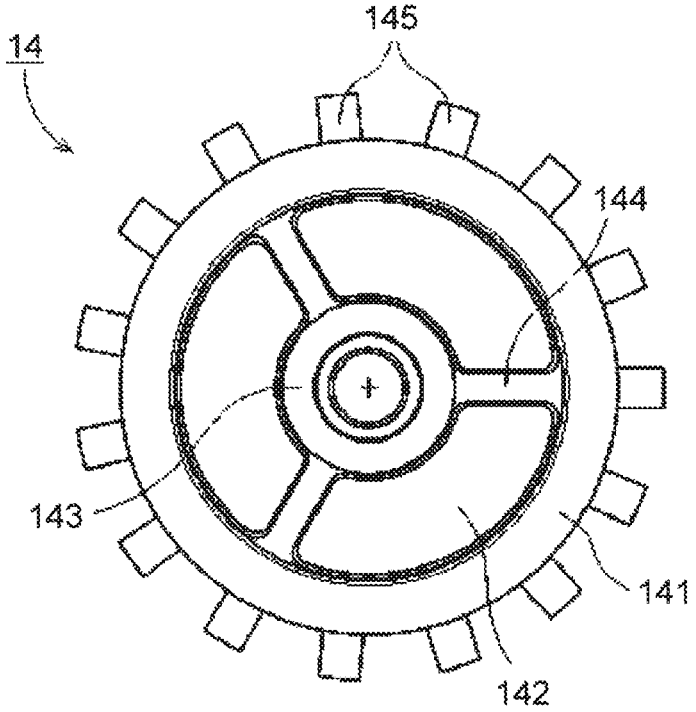
FIG. 3 is a bottom view of the stator housing.

The stator housing 14 is fixed to the casing 30 and is a member for holding the stator 13. FIG. 2 is a longitudinal sectional view of the stator housing 14. FIG. 3 is a bottom view of the stator housing 14. As illustrated in FIG. 1 to FIG. 3, the stator housing 14 has a cylindrical portion 141, a disc portion 142, a bearing holding portion 143, a plurality of ribs 144, and a plurality of protruding portions 145.

The cylindrical portion 141 extends in a substantially cylindrical shape in the axial direction on the outer side of the stator 13 in the radial direction. The stator core 131 is fixed to the inner peripheral surface of the cylindrical portion 141. The upper end portion of the cylindrical portion 141 extends to the upper side of the stator 13. The disc portion 142 spreads inward in the radial direction from the upper end portion of the cylindrical portion 141. The bearing holding portion 143 extends substantially in a cylindrical shape from the inner end portion of the disc portion 142 in the radial direction toward the upper side and the lower side. The plurality of the ribs 144 connect the outer peripheral surface of the bearing holding portion 143 and the inner peripheral surface of the cylindrical portion 141 in the radial direction to each other on the lower surface side of the disc portion 142. The rigidity of the stator housing 14 is enhanced by the plurality of the ribs 144. The plurality of the protruding portions 145 are provided in a gear shape on the outer peripheral surface of the stator housing 14.

The stator housing 14 of the present embodiment becomes a path for dissipation of heat generated in the stator 13. Therefore, for the material of the stator housing 14, it is preferable to use a metal having high heat dissipation properties such as aluminum or an aluminum alloy. For example, when the air-blowing device 1 is mounted on a medical device, weight reduction of the device as well as reliability is an important design task. By using aluminum or an aluminum alloy, it is possible to reduce the weight of the air-blowing device 1 while increasing the strength of the stator housing 14.

A pair of bearings 51 and 52 are interposed between the bearing holding portion 143 and the shaft 11. For example, ball bearings are used for the bearings 51 and 52. Outer rings of the bearings 51 and 52 are fixed to the inner peripheral surface of the bearing holding portion 143. Inner rings of the bearings 51 and 52 are fixed to the outer peripheral surface of the shaft 11. As a result, the shaft 11, the rotor 12, and the impeller 20 are supported so as to be rotatable with respect to the stator housing 14. Further, the inner rings of the bearings 51 and 52 may oppose the outer circumferential surface of the shaft 11 with a gap therebetween.

In the present embodiment, both of the pair of the bearings 51 and 52 are arranged on the upper side in the axial direction closer to the impeller 20 than the rotor 12. Both of the pair of the bearings 51 and 52 are held by the stator housing 14. In this manner, if the two bearings 51 and 52 are disposed on the same axial side with respect to the rotor 12, it is easy to hold the two bearings 51 and 52 with one component. If the plurality of the bearings 51 and 52 are held by one component, the shaft 11 can be arranged coaxially with respect to the central axis 9.

In the present embodiment, none of the bearings 51 and 52 protrude completely upward from the disc portion 142 of the stator housing 14. The bearing 51 on the upper side is disposed at a position overlapping a portion of the disc portion 142 of the stator housing 14 in a radial direction. The bearing 52 on the lower side is disposed at a position overlapping the cylindrical portion 141 of the stator housing 14 in the radial direction. In this way, the distance from the bearings 51 and 52 to the cylindrical portion 141 is shorter than in the case where the bearing 52 on the lower side is disposed above the cylindrical portion 141 of the stator housing 14. Therefore, it is possible to further suppress the inclination of the stator housing 14 with respect to the shaft 11.

The impeller 20 is fixed to the shaft 11 above the stator housing 14. The impeller 20 rotates about the central axis 9, which extends in the vertical direction. The impeller 20 has a base portion 21 and a plurality of blades 22. The base portion 21 spreads in a direction perpendicular to the central axis 9. The base portion 21 has a disc shape. The plurality of blades 22 are arranged on the upper surface of the base portion 21 at intervals in the circumferential direction. As the material of the impeller 20, for example, a resin such as PBT (polybutylene terephthalate) or PC (polycarbonate) is used. However, a material other than a resin such as a metal may be used as the material of the impeller 20.

The motor 10 and the impeller 20 are disposed inside the casing 30. As illustrated in FIG. 1, the casing 30 of the present embodiment is composed of a first casing member 31 and a second casing member 32 that is arranged on the upper side of the first casing member 31. The first casing member 31 surrounds the stator and the stator housing 14. The second casing member 32 surrounds the periphery of the impeller 20. The plurality of the protruding portions 145 of the stator housing 14 are fitted into through holes 312 of a holder portion 311 of the first casing member 31. The holder portion 311 is formed around the stator housing 14. The through holes 312 penetrate the holder portion 311 in the radial direction.

The first casing member 31 and the second casing member 32 are fixed to each other by screwing or engagement. In addition, an elastomer sealant (not illustrated) is sandwiched between the first casing member 31 and the second casing member 32. The sealant prevents leakage of air from the gap between the first casing member 31 and the second casing member 32.

For example, a resin such as PBT (polybutylene terephthalate) or PC (polycarbonate) is used as the material of the first casing member 31 and the second casing member 32. The first casing member 31 is obtained by so-called insert molding, in which a resin is poured into a mold and solidified while the stator housing 14 is disposed inside the mold. That is, the first casing member 31 of the present embodiment is a resin molded article having the stator housing 14 as an insert component. By using insert molding, the stator housing 14 and the first casing member 31 can be brought into close contact with each other.

However, the first casing member 31 may be molded separately from the stator housing 14, and the stator housing 14 may be fixed to the first casing member 31 with an adhesive or the like after molding.

The casing 30 has an intake port 33 and an exhaust port 34. The intake port 33 penetrates the second casing member 32 in the axial direction on the upper side of the impeller 20. That is, the intake port 33 opens from the space above the second casing member 32 toward the center of the impeller 20. The exhaust port 34 opens in a tangential direction of an imaginary circle centered on the central axis 9 on an outer side of the motor 10 and the impeller 20 in the radial direction. In addition, the casing 30 has therein a wind tunnel 35 that serves as an air flow path. The wind tunnel 35 extends annularly around the motor 10 and the impeller 20. In addition, the intake port 33 and the exhaust port 34 communicate with each other via the wind tunnel 35.

When the motor 10 is driven, the impeller 20 rotates together with the shaft 11. Then, air is sucked from the upper space of the casing 30 through the intake port 33 into the interior of the casing 30. The sucked air is accelerated by the impeller 20 and whirls round the wind tunnel 35. Then, the air whirling round the wind tunnel 35 passes through the exhaust port 34 and is discharged to the outside of the casing 30.

Figure 4:
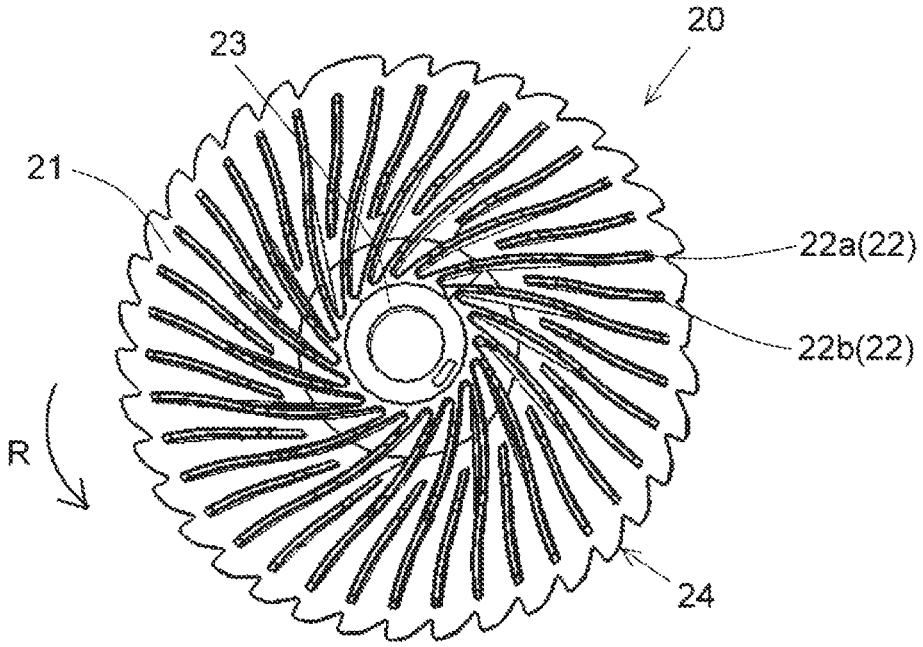
FIG. 4 is a plan view of an impeller according to the first preferred embodiment of the present invention.

FIG. 4 is a plan view of the impeller 20 according to the first embodiment of the present invention. FIG. 4 is a view of the impeller 20 as viewed from above. The impeller 20 has, in addition to the base portion 21 and the plurality of the blades 22, a boss portion 23, which is cylindrical, at a center portion thereof. By fixing the shaft 11 to the boss portion 23, the impeller 20 and the shaft 11 are coupled to each other.

The plurality of the blades 22 are inclined in the same direction as the rotation direction R of the impeller 20 in plan view from the axial direction and extend outward in the radial direction from the boss portion 23. In detail, the plurality of the blades 22 are composed of main wings 22*a* and auxiliary wings 22*b*. The main wings 22*a* extend outward in the radial direction from the boss portion 23. The auxiliary wings 22*b* extend outward in the radial direction from a position that is separated outward from the boss portion 23 in the radial direction. In the present embodiment, in the circumferential direction, the main wings 22*a* and the auxiliary wings 22*b* are alternately arranged. However, in the circumferential direction, a plurality of the auxiliary wings 22*b* may be provided between two main wings 22*a*. In the present embodiment, the outer peripheral edge of the base portion 21 protrudes outward in the radial direction from the outer end portion of the plurality of the blades 22 in the radial direction.

Figure 5:
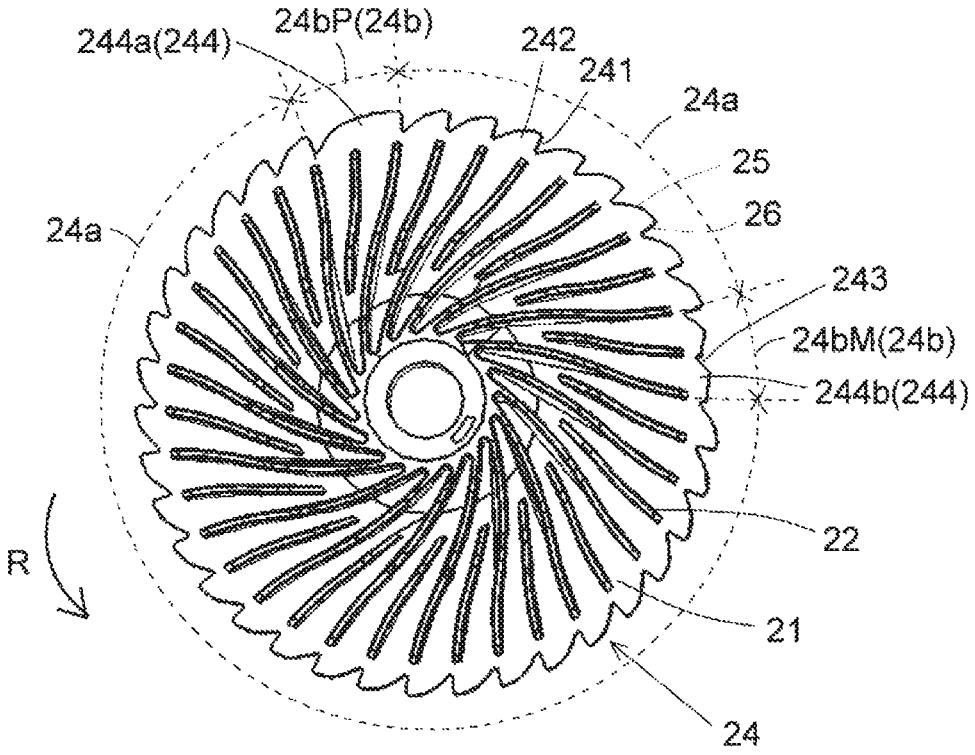
FIG. 5 is a view for explaining an irregular portion of the impeller of the first preferred embodiment of the present invention.

The base portion 21, on the outer side thereof in the radial direction, has an irregular portion 24 in which irregularities are repeated in the circumferential direction. In the present embodiment, the irregular portion 24 is provided at the outer end of the base portion 21 in the radial direction. FIG. is a diagram for explaining the irregular portion 24 of the impeller 20 of the first embodiment. As illustrated in FIG. 5, the irregular portion 24 has at least one of a first irregular region 24*a* and a second irregular region 24*b*. In the present embodiment, although the number of the first irregular regions 24*a* is two, it may be one or three or more. In addition, in the present embodiment, the number of the second irregular regions 24*b* is two, but may be one or three or more.

The first irregular regions 24*a* include a plurality of first recessed portions 241 having the same shape and a plurality of first projecting portions 242 having the same shape. In the present embodiment, the first recessed portions 241 are recessed inward in the radial direction and the first projecting portions 242 protrude outward in the radial direction. In the first irregular regions 24*a*, the first recessed portions 241 and the first projecting portions 242 are alternately arranged one by one. The first irregular regions 24*a* have a corrugated shape in which irregularities are regularly repeated in the circumferential direction. Further, the number of the first recessed portions 241 and the first projecting portions 242 included in each of the first irregular regions 24*a* may be two or more, and the number thereof is not particularly limited. In the present embodiment, most of the outer end of the base portion 21 in the radial direction is occupied by the first irregular regions 24*a*.

The second irregular regions 24*b* are located between the first irregular regions 24*a*. In the present embodiment, the number of the first irregular regions 24*a* is plural, and the second irregular regions 24*b* are located between two first irregular regions 24*a*. When the number of the first irregular regions 24*a* is one, the second irregular region 24*b* is located between the two end portions of one first irregular region

24*a* in the circumferential direction. The second irregular regions 24*b* each include at least one of a second recessed portion 243 having a shape different from that of the first recessed portions 241 and a second projecting portion 244 having a shape different from that of the first projecting portions 242. In the present embodiment, the second recessed portions 243 are recessed inward in the radial direction, and the second projecting portions 244 protrude outward in the radial direction. The second irregular regions 24*b* have a shape in which the regular arrangement of the first irregular region 24*a* is broken. In the present embodiment, the second irregular regions 24*b* are each formed in a narrow circumferential region of the outer end of the base portion 21 in the radial direction. There are two second irregular regions 24*b*.

Specifically, the second irregular region 24*b* may have a first pattern having the second recessed portion 243 and the second projecting portion 244. The second irregular regions 24*b* may have a second pattern having only the second recessed portion 243 out of the second recessed portion 243 and the second projecting portion 244. The second irregular region 24*b* may have a third pattern having only the second projecting portion 244 out of the second recessed portion 243 and the second projecting portion 244. In the present embodiment, the impeller 20 has one second irregular region 24*b* having the first pattern and one second irregular region 24*b* having the third pattern. However, this is an example, and the impeller 20 may include the second irregular regions 24*b* having at least one of the first to third patterns.

The second irregular regions 24*b* can be formed by changing the irregular shape of a portion of the first irregular region 24*a*. Although details will be described later, in the present embodiment, the impeller 20 includes two types of the second irregular regions 24*b*, that is, a plus balance region 24*b*P and a minus balance region 24*b*M, which are formed by using the irregular shape of the first irregular region 24*a*.

The plus balance region 24*b*P is a region in which balance adjustment for making a portion of the impeller 20 heavy has been performed. The minus balance region 24*b*M is a region where balance adjustment for lightening a portion of the impeller 20 has been performed. That is, according to the configuration of this embodiment, it is possible to appropriately perform balance adjustment of the impeller 20 using the irregular portion 24 using the plus balance adjustment and the minus balance adjustment. In addition, in the present embodiment, because the irregular portion 24 used for adjusting the balance of the impeller 20 is provided at the outer end of the base portion 21 in the radial direction, the thickness of the impeller 20 in the axial direction can be reduced. That is, the configuration of the present embodiment is suitable for balance adjustment of the impeller 20, which is thin.

Further, the impeller 20 may have only one of the plus balance region 24*b*P and the minus balance region 24*b*M as the second irregular region 24*b*. In addition, the impeller 20 may have, as the second irregular region 24*b*, a region where both the plus balance and the minus balance are performed.

In the present embodiment, the first projecting portion 242 and the second projecting portion 244 have a pair of side surfaces, namely, a front side surface 25 and a rear side surface 26, facing each other in the circumferential direction. The front side surface 25 corresponds to the front side in the rotation direction of the impeller 20 and the rear side surface 26 corresponds to the rear side in the rotation direction of the impeller 20. The front side surface 25 is inclined with respect to the circumferential direction. The rear side surface 26 is perpendicular to the circumferential direction and is not inclined. Therefore, the width in the circumferential direction of the first projecting portion 242 and the second projecting portion 244 is narrower in the end portion that is outwardly separated from the base portion 21 than the end portion on the base portion 21 side. With such a configuration, it is possible to suppress the occurrence of turbulent flow in the irregular region when the impeller 20 rotates. As a result, sound generated when the impeller 20 rotates can be reduced.

Further, the front side surface 25 that is inclined with respect to the circumferential direction may be a flat surface or a curved surface. As illustrated in FIG. 5, in this embodiment, the front side surface 25 is a curved surface. When the front side surface 25 is a curved surface, it is preferable that the curved surface be a projecting surface directed outward from the impeller 20.

Figure 6:
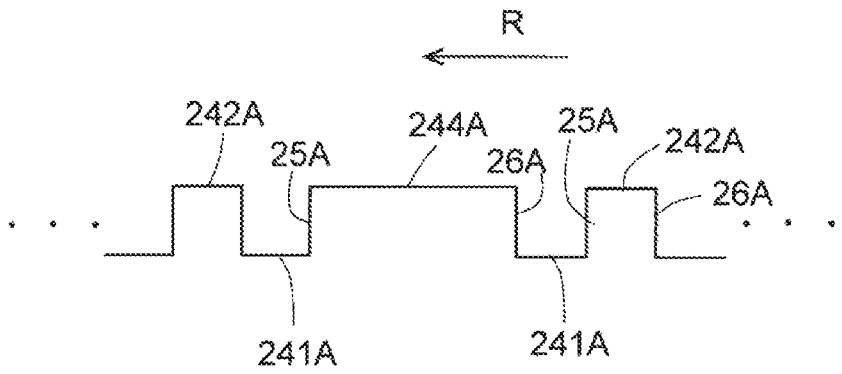
FIG. 6 is a view illustrating a modification example of first projecting portions and a second projecting portion.

FIG. 6 is a view illustrating a modification example of the first projecting portions 242 and the second projecting portion 244. Further, in FIG. 6, irregularities, which are originally arranged in the circumferential direction, are illustrated as irregularities aligned in a linear direction for the sake of convenience. This point is the same in FIG. 7, FIG. 8, FIG. 9, and FIG. 10 explained below. As illustrated in FIG. 6, both a front side surface 25A and a rear side surface 26A of first projecting portions 242A and a second projecting portion 244A are configured to be perpendicular to the circumferential direction, and need not be inclined with respect to the circumferential direction. In the configuration illustrated in FIG. 6, the first projecting portions 242A, the second projecting portion 244A, and recessed portions 241A have a rectangular shape in plan view from the radial direction.

The second irregular region 24*b* will be described in more detail.

Figure 7:
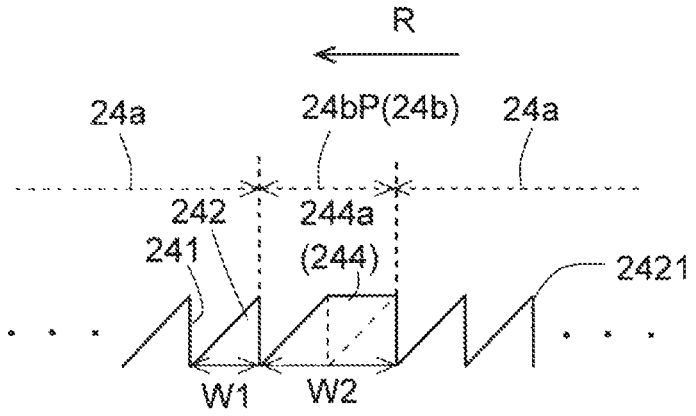
FIG. 7 is a diagram for explaining a plus balance region.

FIG. 7 is a diagram for explaining the plus balance region 24*b*P. The second irregular region 24*b* forming the plus balance region 24*b*P includes a second projecting portion 244*a* having a shape different from that of the first projecting portions 242. In the example illustrated in FIG. 7, the plus balance region 24*b*P has one first recessed portion 241 and one second projecting portion 244*a*. The plus balance region 24*b*P has only the second projecting portion 244 out of the second recessed portion 243 and the second projecting portion 244.

The width of the second projecting portion 244*a* in the circumferential direction is wider than that of the first projecting portion 242. In the example illustrated in FIG. 7, the circumferential width W2 of the second projecting portion 244*a* is wider than the circumferential width W1 of the first projecting portion 242. That is, the region of the projecting portion indicated by the width W2 is larger than the region of the projecting portion indicated by the width W1. Such a configuration can be formed, for example, by filling the first recessed portion 241 constituting the first irregular region 24*a* and connecting the adjacent ones of the first projecting portions 242 to each other. Further, in the example illustrated in FIG. 7, the length of the second projecting portion 244*a* in the radial direction is the same as the length of the first projecting portion 242 in the radial direction.

The second projecting portion 244*a* has a shape in which at least a portion of at least one first recessed portion 241 is filled with the same material as the base portion 21. In detail, the second projecting portion 244*a* is filled with the same material as that of the base portion 21 so that the adjacent ones of the first projecting portions 242 are connected to each other. Such a configuration can be formed by, for example, scraping off the projecting portions of the irregular portion of the mold that forms the first irregular region 24*a* when molding the impeller 20. In the example illustrated in FIG. 7, the second projecting portion 244*a* is formed by filling one first recessed portion 241 with the same material as the base portion 21. That is, the weight of the portion increases by an amount equal to the amount of material filled in the first recessed portion 241.

In the example illustrated in FIG. 7, the second projecting portion 244*a* has a shape in which apexes 2421 of at least two adjacent ones of the first projecting portions 242 are connected to each other. More specifically, the second projecting portion 244*a* has a shape in which the apexes 2421 of two adjacent ones of the first projecting portions 242 are connected to each other. That is, in the example illustrated in FIG. 7, the second projecting portion 244*a* is formed by filling the entirety of one first recessed portion 241 with the same material as the base portion 21. According to the present embodiment, it is possible to prevent the formation of a groove recessed in the radial direction in the second projecting portion 244*a*. For this reason, it is possible to suppress generation of turbulent flow when the impeller 20 rotates.

Figure 8:
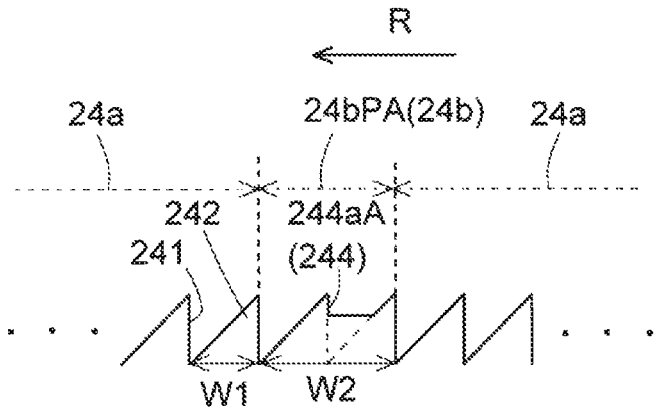
FIG. 8 is a view for explaining a modification example of the second projecting portion included in the plus balance region.

FIG. 8 is a view for explaining a modification example of the second projecting portion 244*a* of the plus balance region 24*b*P. In a plus-balance region 24*b*PA of the modification illustrated in FIG. 8, a second projecting portion 244*a*A has a shape formed by filling only a portion of the first recessed portion 241 with the same material as the base portion 21. Also in the modification example illustrated in FIG. 8, the circumferential width W2 of the second projecting portion 244*a*A is larger than the circumferential width W1 of the first projecting portion 242. Such a configuration can be formed at the time of molding the impeller 20 by scraping off a portion of the projecting portions among the irregular portions that form the first irregular regions 24*a* of the mold. That is, according to the adjustment amount of the plus balance of the impeller 20, it is possible to adjust the amount of scraping off of the projecting portions among the irregular portions that form the first irregular regions 24*a* of the mold.

In addition, the second projecting portions 244*a* included in the plus balance region 24*b*P may be formed by filling a plurality of the first recessed portions 241 with the same material as the base portion 21. In this case, the width of the second projecting portion in the circumferential direction is wider than that of the second projecting portions 244*a* and 244*a*A illustrated in FIGS. 7 and 8.

Figure 9:
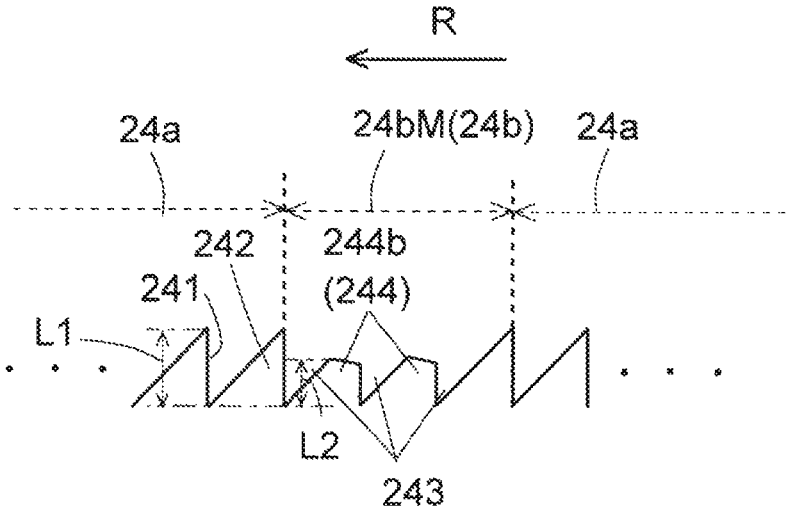
FIG. 9 is a diagram for explaining a minus balance region.

FIG. 9 is a diagram for explaining the minus balance region 24*b*M. The second irregular region 24*b* constituting the minus balance region 24*b*M includes a second projecting portion 244*b* having a shape different from that of the first projecting portion 242. In the example illustrated in FIG. 9, the minus balance region 24*b*M has three second recessed portions 243 having shapes different from that of the first recessed portion 241, and has one first projecting portion 242 and two second projecting portions 244*b*. The minus balance region 24*b*M has both the second recessed portions 243 and the second projecting portions 244. Further, in the example illustrated in FIG. 9, the shapes of the three second recessed portions 243 are different from each other.

The length of the second projecting portion 244*b* in the radial direction is shorter than that of the first projecting portion 242. In the example illustrated in FIG. 9, the length L2 of the second projecting portion 244*b* in the radial direction is shorter than the length L1 of the first projecting portion 242 in the radial direction. Such a configuration can be formed, for example, by scraping off the tops of the first projecting portions 242 constituting the first irregular regions 24*a*.

Further, in the example illustrated in FIG. 9, there are two second projecting portions 244*b* and each of the second projecting portions 244*b* has a shorter length in the radial direction than the first projecting portion 242. However, the lengths L2 of the two second projecting portions 244*b* in the radial direction may be different from each other. In addition, the minus balance region 24*b*M may have one or three or more second projecting portions 244*b*.

Figure 10:
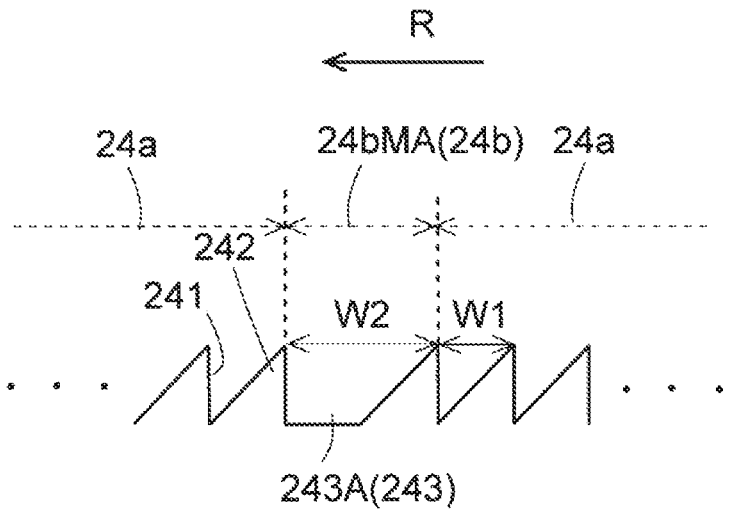
FIG. 10 is a diagram for explaining a modification example of the minus balance region.

FIG. 10 is a diagram for explaining a modification example of the minus balance region 24*b*M. In the modification example illustrated in FIG. 10, the second irregular region 24*b* constituting a minus balance region 24*b*MA includes a second recessed portion 243A having a different shape from the first recessed portion 241. The minus balance region 24*b*MA has one second recessed portion 243A and one first projecting portion 242. The minus balance region 24*b*MA has only the second recessed portion 243 out of the second recessed portion 243 and the second projecting portion 244.

The second recessed portion 243A has a wider circumferential width than the first recessed portion 241. In the modification illustrated in FIG. 10, the width W2 of the second recessed portion 243A in the circumferential direction is larger than the width W1 of the first recessed portion 241 in the circumferential direction. Such a structure can be formed, for example, by scraping off the entirety of the first projecting portion 242 constituting the first irregular region 24*a*.

A second recessed portion 234A has a shape formed by scraping off at least one first projecting portion 242. As a result, after the impeller 20 has been formed, the balance adjustment for making a portion of the impeller 20 light can be performed. That is, the amount of scraping off of the first projecting portions 242 can be adjusted according to the adjustment amount of the minus balance of the impeller 20. In the modification example illustrated in FIG. 10, only one first projecting portion 242 is scraped off, but a plurality of the first projecting portions 242 may be scraped off to form a second recessed portion.

As illustrated in FIG. 1, an impeller blade wheel 60 includes the impeller 20 and the shaft 11. The shaft 11 is connected to the impeller 20. As described above, the impeller 20 is configured so that plus balance adjustment and minus balance adjustment can be performed. For this reason, the impeller blade wheel 60 can rotate with good balance.

In addition, as illustrated in FIG. 1, the air-blowing device 1 has the impeller blade wheel 60, the magnet 122, and the stator 13. The magnet 122 is arranged outward of the shaft 11 in the radial direction. The stator 13 opposes the magnet 122 in the radial direction. In the present embodiment, the stator 13 is disposed outward of the magnet 122 in the radial direction. As described above, because the impeller blade wheel 60 having the impeller 20 rotates in a well-balanced manner, the air-blowing device 1 can reduce the sound generated during rotation.

Further, in the present embodiment, the motor 10 is a so-called inner rotor type motor. However, the motor 10 may be a so-called outer rotor type motor in which the magnet 122 is arranged outward in the radial direction with respect to the stator 13.

Figure 11:
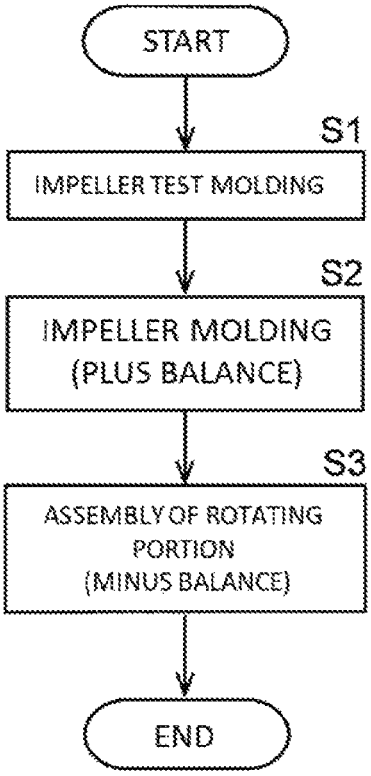
FIG. 11 is a flowchart illustrating an example of a method of manufacturing the air-blowing device according to the first preferred embodiment of the present invention.
Figure 12:
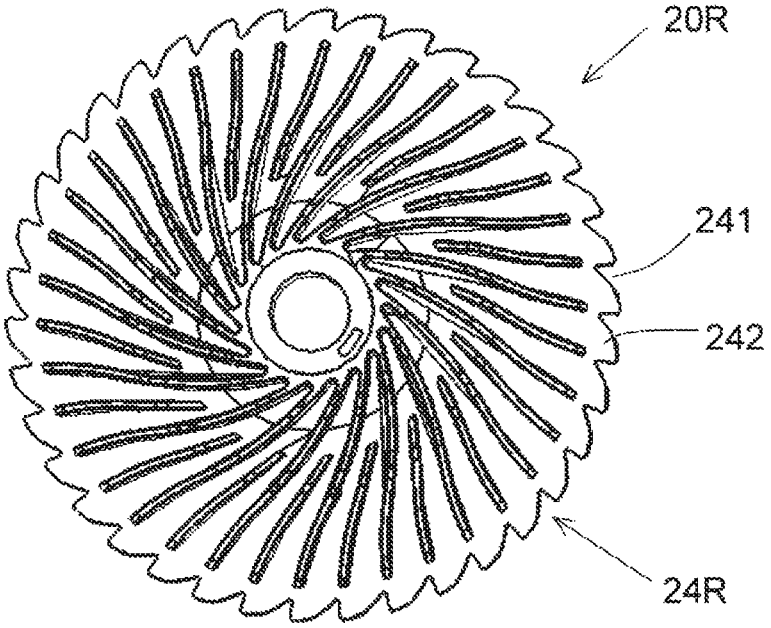
FIG. 12 is a plan view illustrating an impeller obtained by test molding.

FIG. 11 is a flowchart illustrating an example of a manufacturing method of the air-blowing device 1 according to the first embodiment of the present invention. The method of manufacturing the air-blowing device 1 having the impeller 20 includes a step (step S1) of preparing the impeller 20. In the present embodiment, the impeller 20 is formed by resin molding. FIG. 12 is a plan view illustrating an impeller 20R obtained by test molding. The impeller 20R obtained by test molding has an irregular portion 24R in which the first recessed portions 241 and the first projecting portions 242 are alternately arranged one by one in the circumferential direction. That is, the irregular portion 24R has only the first irregular region 24*a*.

Molds used for resin molding include manufacturing errors that occur when manufacturing the mold itself. Therefore, for each mold, the impeller 20R obtained by the test mold has a different balance state. The manufacturing error of the mold can be grasped by the test mold. Further, in the mold used in the test molding, irregularities that form the irregular portion 24R are regularly arranged.

The manufacturing method of the air-blowing device 1 includes a step (step S2) of forming the impeller 20 that is balanced that involves providing a portion for increasing the weight by scraping off the projecting portions of the irregularities regularly arranged in the mold. As described above, it is possible to grasp which portion of the metal mold used for the test molding can be balanced by adjusting the shape of the impeller 20 by test molding. In step S2, on the basis of the result of the test molding, a plus balance adjustment for increasing the weight of the impeller 20 with respect to a portion of the impeller 20 is performed by scraping off the projecting portions of a portion of the mold to obtain the impeller 20 that is balanced. As a result, imbalance of the impeller 20 resulting from a manufacturing error of the mold can be suppressed.

Further, if the balance of the impeller 20R obtained by test molding is good, there is no need to perform plus balance adjustment. That is, in this case, there is no need to improve the metal mold by scraping off the projecting portions.

The manufacturing method of the air-blowing device 1 includes a step (step S3) of adjusting the balance of the impeller 20 that involves, at the time of assembling the rotating portion including the impeller 20, scraping off the projecting portions of the impeller 20 formed by the irregularities of the mold to reduce the weight of a portion of the impeller. In the present embodiment, the first projecting portions 242 are scraped off to reduce the weight of a portion of the impeller 20. In addition to the impeller 20, the rotating portion includes, for example, the shaft 11, the bearings 51 and 52, the rotor 12, and the like. When assembling the rotating portion, an assembly error may occur due to a deviation of the assembly position or the like. Due to this assembly error, the balance at the time of rotation of the impeller 20 sometimes deteriorates. Step S3 is carried out in order to eliminate imbalance resulting from this assembly error. In step S3, at least a portion of at least one of the first projecting portions 242 of the impeller 20 is scraped off and the rotation balance of the impeller 20 is adjusted.

Further, if the rotation balance of the impeller 20 is good when the rotating portion is assembled, there is no need to adjust the minus balance. That is, in this case, there is no need to scrape off the first projecting portions 242 of the impeller 20.

According to the manufacturing method of the air-blowing device 1 of the present embodiment, plus balance adjustment and minus balance adjustment are performed and the balance of the impeller 20 is adjusted. In the plus balance adjustment, the balance adjustment is performed by increasing the weight of a portion of the impeller 20. For the minus balance adjustment, balance is adjusted by lightening the weight of a portion of the impeller 20. Therefore, the balance adjustment of the impeller 20 can be appropriately performed. In addition, according to the method of manufacturing the air-blowing device 1 of the present embodiment, the rotational portion is assembled by using the impeller 20 whose imbalance has been reduced by the plus balance adjustment based on the test molding. Therefore, it is possible to reduce imbalance that occurs after assembly of the rotating portion. For this reason, it is possible to reduce the work burden by reducing the amount by which the first projecting portions 242 are scraped off at the time of adjusting the minus balance.

Next, the impeller of the second embodiment will be described. The structures of the impeller blade wheel and the air blower having the impeller of the second embodiment are the same as those of the first embodiment. Therefore, we will focus on the impeller.

Figure 13:
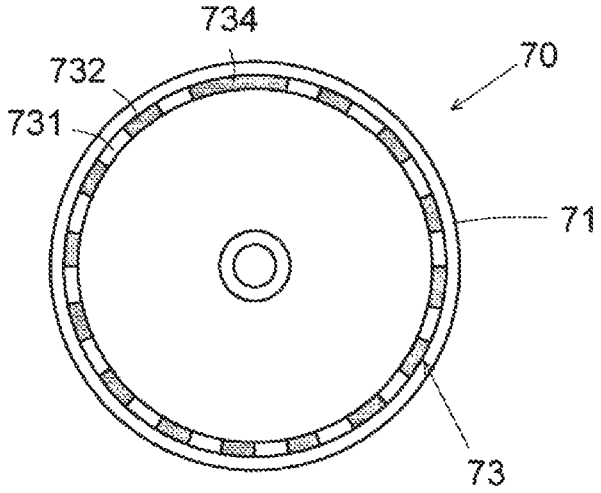
FIG. 13 is a plan view of an impeller according to a second preferred embodiment of the present invention.
Figure 14:
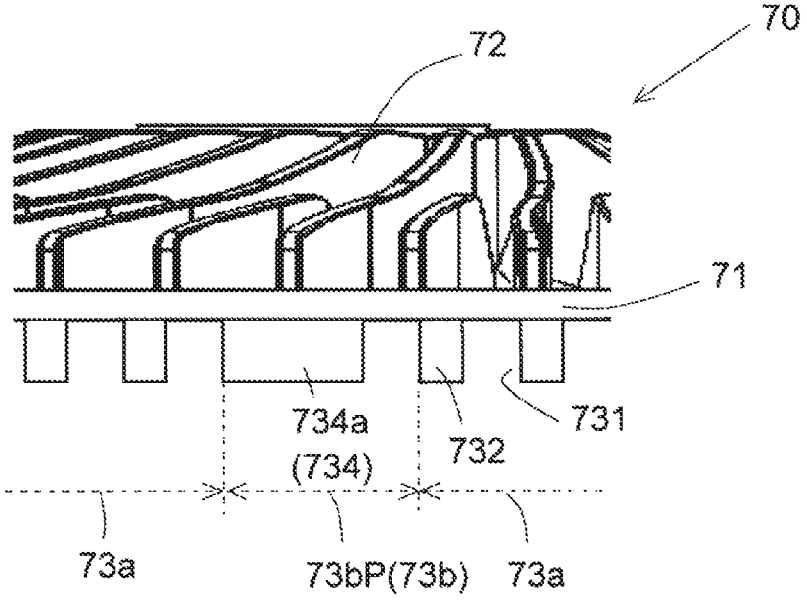
FIG. 14 is an enlarged plan view of a portion of the impeller according to the second preferred embodiment of the present invention.
Figure 15:
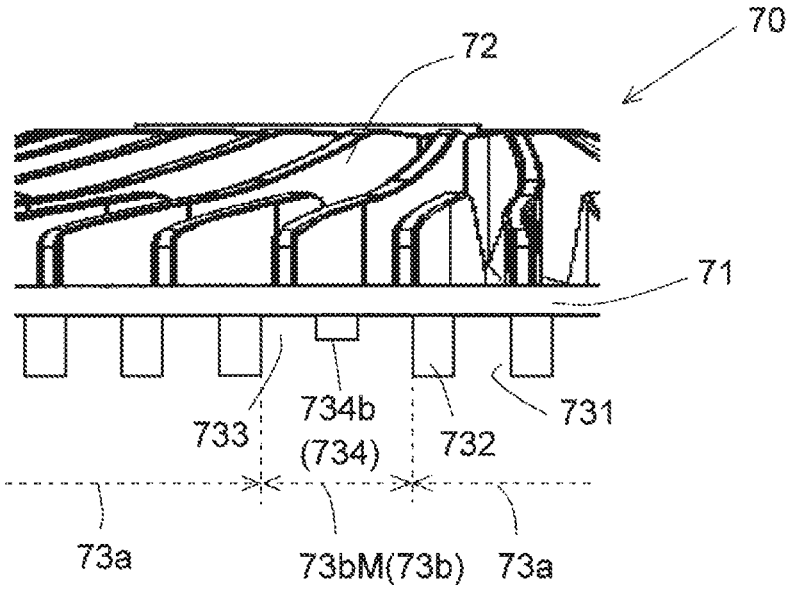
FIG. 15 is an enlarged plan view of another portion of the impeller according to the second preferred embodiment of the present invention.

FIG. 13 is a plan view of an impeller 70 according to the second embodiment of the present invention. FIG. 13 is a view of the impeller 70 as viewed from below. FIG. 14 is an enlarged plan view of a portion of the impeller 70 according to the second embodiment of the present invention. FIG. 14 is a side view of the impeller 70. FIG. 15 is an enlarged plan view of another portion of the impeller 70 according to the second embodiment of the present invention. FIG. 15 is a view of the impeller 70 as viewed from the side as in FIG. 14, but is a view as seen from an angle different from that in FIG. 14.

As in the first embodiment, the impeller 70 includes a base portion 71 and a plurality of blades 72. The base portion 71 spreads out in a direction perpendicular to the central axis 9. The plurality of the blades 72 are arranged on the upper surface of the base portion 71 at intervals in the circumferential direction.

The base portion 71 has an irregular portion 73 in which irregularities are repeated in the circumferential direction on the outer side in the radial direction and on the surface of the base portion 71 opposite to the surface on which the blades 72 are disposed. The irregular portion 73 has a plurality of first irregular regions 73*a* and a second irregular region 73*b*. The first irregular regions 73*a* include a plurality of first recessed portions 731 having the same shape and a plurality of first projecting portions 732 having the same shape. In the first irregular regions 73*a*, the first recessed portions 731 and the first projecting portions 732 are arranged one by one alternately in the circumferential direction. The second irregular region 73*b* is located between two first irregular regions 73*a*. The second irregular region 73*b* includes at least one of a second recessed portion 733 having a shape different from that of the first recessed portions 731 and a second projecting portion 734 having a shape different from that of the first projecting portions 732.

In this embodiment, the irregular portion 73 is provided on the lower surface of the base portion 71. The first recessed portion 731 and the second recessed portion are recessed upward in the axial direction. The first projecting portion 732 and the second projecting portion 734 protrude downward in the axial direction. With such a configuration, it is possible to reduce the size in the radial direction of the impeller 70 provided with the irregular portion 73 for balance adjustment.

Further, in this embodiment, both the first recessed portion 731 and the first projecting portion 732 are rectangular in plan view from the radial direction. However, this is an example and the shape may be the same as that of the first embodiment. That is, the first projecting portion 732 and the second projecting portion 734 may have a shape in which, out of a pair of side surfaces that oppose each other in the circumferential direction, the side surface that corresponds to the front side of the impeller 70 in the rotation direction is inclined in the circumferential direction.

As illustrated in FIG. 14 and FIG. 15, also in this embodiment, the second irregular region 73*b* has a plus balance region 73*b*P and a minus balance region 73*b*M. The plus balance region 73*b*P has a second projecting portion 734*a* having a wider circumferential width than the first projecting portion 732. The second projecting portion 734*a* can be formed by filling the first recessed portion 731 with the same material as the base portion 71. Further, the first recessed portion 731 may be entirely or partially filled with the same material as that of the base portion 71.

In addition, the second irregular region 73*b* constituting the minus balance region 73*b*M includes a second projecting portion 734*b* having a shape different from that of the first projecting portion 732. The length of the second projecting portion 734*b* in the axial direction is smaller than that of the first projecting portion 732. The second projecting portion 734*b* having such a configuration can be formed by scraping off the top portion of the first projecting portion 732. Further, the minus balance region 73*b*M may have the second recessed portion 733 formed by scraping off the entirety of the first projecting portion 732.

Also in the present embodiment, it is possible to properly perform the balance adjustment of the impeller 70 using the irregular portion 73 by using plus balance adjustment and minus balance adjustment. For this reason, the impeller blade wheel can be rotated in a well-balanced manner and the noise of the air-blowing device can be suppressed.

Various modifications can be made to the various technical features disclosed in this specification within the scope without departing from the gist of the technical creation. In addition, the embodiments and modifications described in this specification may be implemented in combination to the extent possible.

The present invention can be used for, for example, air-blowing devices used in medical equipment, household appliances, office automation equipment, in-vehicle devices and the like.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An impeller that rotates about a vertically extending central axis, the impeller comprising:

a base portion that extends out in a direction perpendicular to the central axis; and blades arranged on an upper surface of the base portion at spaced intervals in a circumferential direction; wherein the base portion includes, on an outer side thereof in a radial direction, an irregular portion that includes:

one or more first irregular regions including first recessed portions with a same shape and first projecting portions with a same shape, the first recessed portions and the first projecting portions being alternately arranged one by one;

a second irregular region located between end portions of the one or more first irregular regions and including a second recessed portion with a shape different from that of the first recessed portions and a second projecting portion with a shape different from the first projecting portions; and a third irregular region including at least one of a third recessed portion with a shape different from that of the first recessed portions and the second recessed portion and a third projecting portion with a shape different from the first projecting portions and the second projecting portion;

the first projecting portions rind the second projecting portion include pairs of side surfaces that are provided on opposing ends of the first projecting portions and the second projecting portion in the circumferential direction;

ones of the pairs of side surfaces of the first projecting portions and the second projecting portion which correspond to front sides of the first projecting portions and the second projecting portions in a rotation direction of the impeller are inclined with respect to the circumferential direction;

other ones of the pairs of side surfaces of the first projecting portions and the second projecting portion which correspond to rear sides of the first projecting portions and the second projection portion in the rotation direction of the impeller are perpendicular to the circumferential direction; and widths in the circumferential direction of each of the first projecting portions and the second projecting portion at end portions outwardly away from the base portion are narrower than widths in the circumferential direction of each of the first projecting portions and the second projecting portion adjacent to the base portion.

2. The impeller according to claim 1, wherein the irregular portion is provided at an outer end of the base portion in the radial direction;

the first recessed portions and the second recessed portion are recessed inward in the radial direction; and the first projecting portions and the second projecting portion protrude outward in the radial direction.

3. The impeller according to claim 2, wherein a length of the second projecting portion in the radial direction is shorter than that of each of the first projecting portions.

4. The impeller according to claim 1, wherein the irregular portion is provided on a lower surface of the base portion;

the first recessed portions and the second recessed portion are recessed upward in an axial direction; and the first projecting portions and the second projecting portion protrude downward in the axial direction.

5. The impeller according to claim 4, wherein the second projecting portion has a shorter length in the axial direction than each of the first projecting portions.

6. The impeller according to claim 1, wherein the second projecting portion has a larger width in the circumferential direction than each of the first projecting portions.

7. The impeller according to claim 6, wherein the second projecting portion has a shape which corresponds to at least two adjacent portions of the first projecting portions being connected to each other.

8. The impeller according to claim 7, wherein the shape of the second projecting portion corresponds to apexes of the at least two adjacent portions of the first projecting portions being connected to each other.

9. The impeller according to claim 1, wherein the second recessed portion has a wider circumferential width than each of the first recessed portions.

10. The impeller according to claim 9, wherein the second recessed portion has a shape defined by removing a portion of at least one of the first projecting portions.

11. An impeller blade wheel comprising:

the impeller according to claim 1; and a shaft connected to the impeller.

12. An air-blowing device comprising:

the impeller blade wheel according to claim 11;

a magnet disposed outward of the shaft in the radial direction; and a stator that opposes the magnet in the radial direction.

* * * * *